US005992527A

United States Patent [19]

Garnham et al.

[11] Patent Number: 5,992,527

[45] Date of Patent: Nov. 30, 1999

[54] WELLHEAD ASSEMBLY

[75] Inventors: David Garnham, NR Leeds; Brian Hart, Wakefield; Craig Duell, Soulton WEM, all of United Kingdom

[73] Assignees: Cooper Cameron Corporation, Houston, Tex.; BP Exploration Operating Company, Ltd., London, United Kingdom

[21] Appl. No.: 08/950,655

[22] Filed: Oct. 15, 1997

[30] Foreign Application Priority Data

Nov. 29, 1996 [EP] European Pat. Off. ..... 96308672

[51] Int. Cl.[6] ..... E21B 33/03; E21B 33/04

[52] U.S. Cl. ..... 166/379; 166/86.1; 166/88.1; 166/89.2; 166/88.4

[58] Field of Search ..... 166/347, 368, 166/379, 382, 86.1, 88.1, 89.2, 88.4, 97.1

[56] References Cited

U.S. PATENT DOCUMENTS

| | | | |
|---|---|---|---|
| 2,546,638 | 3/1951 | Humason | 166/88.1 |
| 3,115,934 | 12/1963 | Rector | 166/97.5 |
| 3,190,354 | 6/1965 | Stone | 166/379 X |
| 3,481,395 | 12/1969 | Sizer et al. | 166/368 X |
| 4,491,176 | 1/1985 | Reed | 166/88.4 X |
| 4,703,807 | 11/1987 | Weston | 166/379 X |
| 5,143,158 | 9/1992 | Watkins et al. | 166/368 X |
| 5,535,826 | 7/1996 | Brown et al. | 166/363 |
| 5,544,707 | 8/1996 | Hopper et al. | 166/382 |
| 5,865,250 | 2/1999 | Gariepy | 166/88.1 X |
| 5,868,203 | 2/1999 | Cunningham | 166/344 |
| 5,873,415 | 2/1999 | Edwards | 166/368 X |

FOREIGN PATENT DOCUMENTS

| | | |
|---|---|---|
| 2192921 | 1/1988 | United Kingdom . |
| 2267920 | 12/1993 | United Kingdom . |
| 8601852 | 3/1956 | WIPO . |

OTHER PUBLICATIONS

Cooper Oil Tool; Phillips Petroleum Company Ann Subsea Facility; TMH0445, Nov. 1991; (pp. CCH 36064–36223).

*Primary Examiner*—George Suchfield
*Attorney, Agent, or Firm*—Conley, Rose & Tayon, P.C.

[57] ABSTRACT

A wellhead assembly in which an in-line tree (10) is landed within a wellhead housing (3). The in-line tree has a vertical production through bore (11), two hydraulically or electrically controllably in-line valves (13A, 13B) in the vertical production bore, and a lateral bore (16) leading from the vertical production through bore. A horizontal tree (20) having a vertical through bore (23) is landed on the wellhead housing (3) so that the in-line tree (20) is within the vertical bore. The horizontal tree has a lateral bore (24) which is aligned with the lateral bore (16) of the in-line tree. The in-line tree (10) can be run in and retrieved through the horizonal tree (20). Alternatively the horizontal tree (20) can be removed from the wellhead housing (3) without a BOP if the in-line valves (13A, 13B) are closed.

21 Claims, 3 Drawing Sheets

WELLHEAD ASSEMBLY

CROSS REFERENCE OF RELATED APPLICATIONS

The present invention relates to a development of the wellhead assembly disclosed in our earlier application, EP-A-572732.

BACKGROUND OF THE INVENTION

This earlier application discloses a horizontal tree having a comparatively large vertical bore without any vertical in-line internal valves, and which is at least large enough for the tubing hanger to be landed in the bore. A lateral production fluid outlet port leads from the vertical through-bore. The tubing hanger and horizontal tree are provided within complementary guide means to orientate the tubing hanger to a predetermined angular position at which a lateral production fluid outlet port in the tubing hanger is in alignment with that in the horizontal tree.

With such a horizontal tree, it is necessary to remove the blow out preventer (BOP) from the wellhead assembly to install the horizontal tree, and then replace the BOP on the horizontal tree before the tubing completion can be run. When the tubing completion is run, and before the BOP is removed, the production bore must be sealed with a wireline set plug. In addition, for safety reasons, it is necessary to be able to isolate any potential production fluid outlet. Thus, in operation, the wellhead assembly requires at least one wireline set plug in the vertical production bore above the lateral production bore, and also requires at least one gate valve for the production fluid in the lateral production bore.

SUMMARY OF THE INVENTION

According to the present invention there is provided a wellhead assembly comprising a wellhead housing; an inline tree within the wellhead housing, the in-line tree comprising a housing having a vertical production through bore, an in-line valve in the vertical production through bore, and a lateral bore leading from the vertical production through bore out of the housing of the in-line tree; and landed on the wellhead housing a horizontal tree having a vertical through bore within which the in-line tree is situated and having a lateral bore which is aligned with the lateral bore in the in-line tree; wherein the in-line tree can be run in and retrieved through the vertical through bore of the horizontal tree without removing the horizontal tree.

Such an assembly provides all of the advantages associated with the wellhead assembly of EP-A-572732 and in particular allows direct vertical access to the completion.

Because the in-line tree can be retrieved through the horizontal tree without removing the horizontal tree, the wellhead assembly offers considerable flexibility. Thus, if it is necessary to pull the in-line tree, this can be achieved by landing a BOP on the horizontal tree, and pulling the in-line tree through the horizontal tree and BOP. Alternatively, the horizontal tree can be pulled without BOP protection while leaving the in-line tree in place, with the valve in the in-line tree closed to provide the necessary isolation for the production bore. It is also possible to install the completion and the in-line tree, and then return to the wellhead at a later date in order to install an appropriate horizontal tree. This is good logistically as the appropriate horizontal tree can be chosen after a completion has been installed.

If double barrier isolation is required for the production fluid outlet, two in-line valves can be provided in the vertical production through bore of the in-line tree below the lateral bore. Because the in-line valves are below the lateral bore, they can provide a double barrier both for the vertical production bore and for the lateral bore, so that the in-line valves replace one of the plugs in the vertical production bore, and the gate valves for the production fluid in the lateral bore. It is necessary to retain one plug in the vertical production bore in order to divert flow to the lateral bores. This provides a simplification of the wellhead structure above the mudline.

The wellhead assembly also preferably includes a tubing hanger which is landed within the wellhead assembly below the in-line tree, and which can be removed from the wellhead through the horizontal tree. The tubing hanger may be permanently attached to the in-line tree. However, if the tubing hanger is releasably attached to the in-line tree, the in-line tree and tubing hanger can be run in together. The two can then be pulled together, or, if necessary, the in-line tree can be released from the tubing hanger, so that only the in-line tree is pulled. The in-line tree preferably comprises a one piece housing containing the in-line valves, the vertical production through bore and lateral bore. This avoids the need for any complex connection and seal between the valves and the lateral bore.

The or each in-line valve is preferably a ball valve of the type well known in the art. The or each valve is preferably hydraulically or electrically actuated, making wireline actuation of the valve unnecessary.

The invention is readily applicable to a dual bore arrangement, in which the in-line tree has a second vertical through bore with a lateral bore aligned with a corresponding lateral bore in the horizontal tree. The additional bore, which may be used for annulus pressure monitoring or gas injection, may also be provided with at least one in-line valve such as a ball valve.

The wellhead assembly of the present invention can be completed by two methods. Firstly, with the wellhead housing installed and a blow out preventer installed on the wellhead housing, by running a tubing hanger in through the blow out preventer and wellhead housing, and landing it within the wellhead housing; running the in-line tree through the blow out preventer and into the wellhead housing above the tubing hanger; with the or each valve in the in-line tree closed, removing the blow out preventer; running the horizontal tree in over the in-line tree and locating it on the top of the housing in such a position that the lateral bore in the horizontal tree is aligned with the lateral bore in the in-line tree; plugging the vertical through bore in the in-line tree above the lateral bore; and opening the or each valve in the in-line tree to allow the production fluid to flow through the wellhead assembly.

Secondly, the wellhead assembly can be completed when the wellhead housing is installed but is not yet exposed to the full production fluid pressure by locating the horizontal tree directly on the wellhead housing; installing a blow out preventer on the horizontal tree; further drilling and casing the well through the horizontal tree and blow out preventer; running a tubing hanger in through the blow out preventer and horizontal tree and landing it within the wellhead housing or horizontal tree; running the in-line tree in through the blow out preventer and horizontal tree, and locating it above the tubing hanger with the lateral bore in the in-line tree aligned with the lateral bore in the horizontal tree; with the or each valve of the in-line tree closed, removing the blow out preventer; plugging the vertical through bore in the in-line tree above the lateral bore; and opening the or each in-line valve to allow the production fluid to flow through the wellhead assembly. With this method, a removable protective sleeve may be landed in the horizontal tree to protect the lateral bores of the horizontal tree during the drilling and casing process.

Both of these methods require only one BOP trip thus saving one BOP trip as compared to EP-A-572732. During a batch drilling process, this saving is even more significant as several wells can be completed in a single BOP trip with a BOP being moved from tree to tree without being pulled to the surface. In addition, the availability of two separate methods of completing the wellhead assembly using the same components provides greater flexibility of wellhead completion.

BRIEF DESCRIPTION OF THE DRAWINGS

An example of a wellhead assembly constructed in accordance with the present invention will now be described with reference to the accompanying drawings, in which.

DESCRIPTION OF THE PREFERRED EMBODIMENTS

Figure 2:
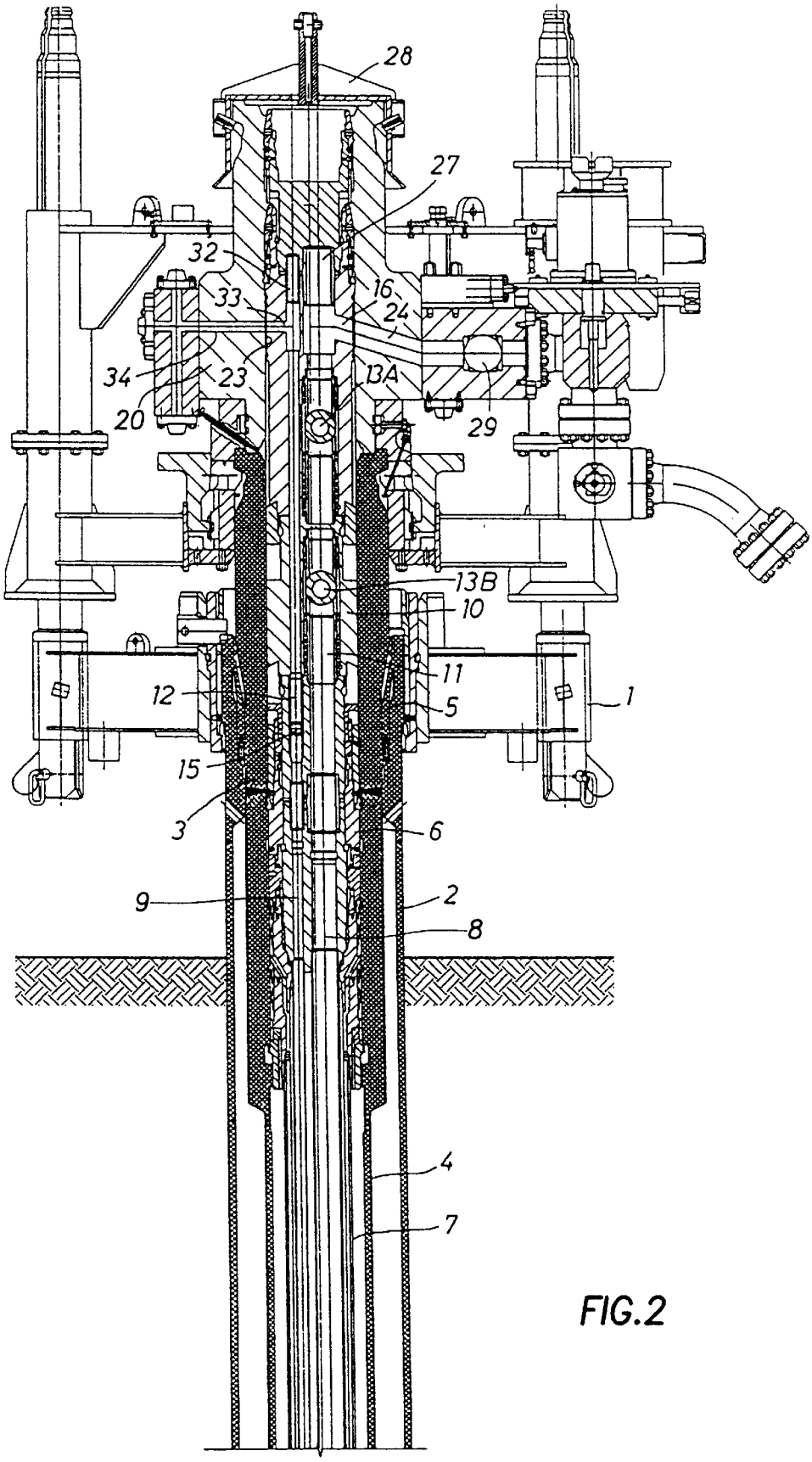
FIG. 2 is a more detailed diagrammatic cross section of the wellhead assembly.

As shown in FIG. 2, the assembly comprises a wellhead guide base 1 from which is suspending a first casing 2 to support the unconsolidated sea bed formation. As is well known in the art, further casings may be landed within first casing 2. A wellhead housing 3 from which a further casing 4 is suspended, is landed within the first casing 2, and is locked by a spring energized collet fingers 5. A tubing hanger 6 from which hangs production tubing 7 is run into the wellhead assembly 3, and is correctly orientated by means of a hydraulically extendable key in the BOP which engages with a helix on the tubing hanger running tool. The seals of the tubing hanger are set and tested in a conventional manner. The tubing hanger has a central vertical production bore 8 and an annulus bore 9.

An in-line tree 10 is run in with tubing hanger 6 and is landed within the wellhead housing 3 above the tubing hanger 6. The in-line tree 10 has a central vertical production bore 11 which is aligned with a production bore 8 in the tubing hanger 6. In addition, the in-line tree 10 has an annulus bore 12 which is aligned with the annulus bore 9 in the tubing hanger 6. Within the production bore 11 are a pair of ball valves 13A, 13B which are controlled through a hydraulic or electrical line 14. The ball valves 13A, 13B are conventional valves which can be controlled selectively to open and close the production bore 11. A further ball valve 15, similarly controlled, is provided in the annulus bore 12. A lateral bore 16 leads radially outwardly from the vertical production bore 11 above the ball valves 13A, 13B. The in-line tree 10 is locked into the housing 3 by means of locking lugs 17 which lock into a complementary recess 18 in a conventional manner.

A horizontal tree 20 is landed on and locked to the wellhead housing 3 by means of locking lugs 21 engaging with a complementary recess 22 in the wellhead housing 3. The horizontal tree has a central vertical through bore 23 which is large enough to allow the in-line tree 10 and the tubing hanger 6 to pass therethrough. A lateral bore 24 leads from the vertical through bore 23, and the in-line tree 10 and horizontal tree 20 are orientated with respect to one another so that the lateral bore 16 in the in-line tree is aligned with the lateral bore 24 in the horizontal tree. This alignment is achieved using a helix and key arrangement similar to that used to align the tubing hanger 6. The interface between the two lateral bores 16, 24 is sealed by a pair of annular metal to metal seals 25, 26.

The vertical through bore 11 is plugged with a plug 27 and capped with a cap 28.

Figure 1:
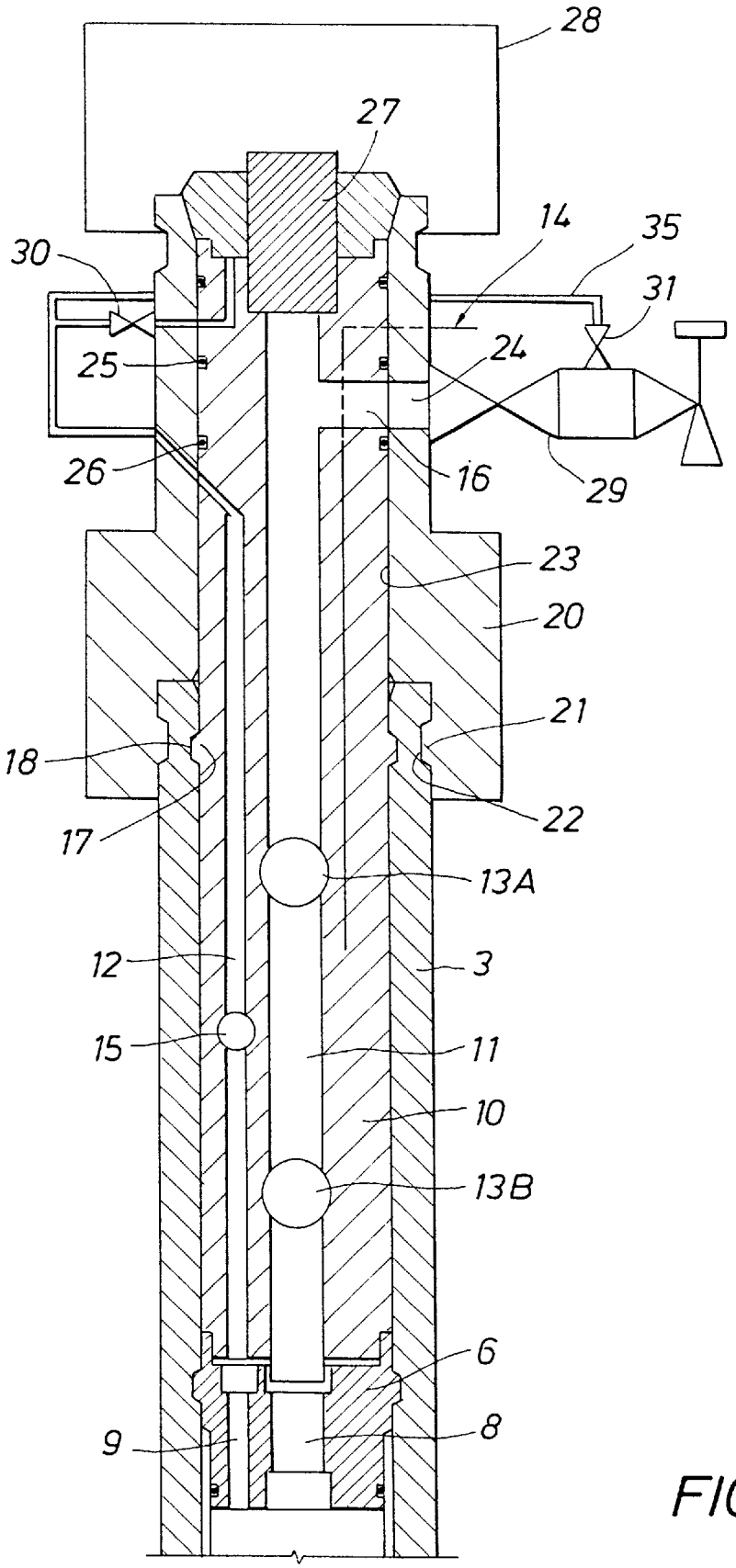
FIG. 1 is a schematic of the wellhead assembly.

The flow through the lateral production bore 24 is controlled by a master valve 29, while the flow through the annular bore 12 is controlled by valves 30 and 31. Although not shown in FIG. 1 the annulus bore 12 is a through bore which is plugged with a plug 32 as shown in FIG. 2. A lateral bore 33 leads from the annulus bore and is aligned with a corresponding lateral bore 34 in the horizontal tree 20. A cross over line 35 leads from the annulus bore 12 to the line for the production fluid to allow the annulus pressure to be monitored via the production fluid.

Once the wellhead assembly is completed, the well can be brought on-line by opening the ball valves 13A, 13B, 15. If access to a completion is required, the ball valves 13A, 13B, 15 are closed to allow the cap 28 and plug 27 to be removed, thereby providing double barrier protection, and allowing a BOP to be installed on the horizontal tree 20. Alternatively, if it is necessary to pull the horizontal tree 20, the ball valves 13A, 13B are again closed, and the cap 28 and plug 27 are removed. The horizontal tree 20 can then be pulled without the need for a BOP.

Figure 3:
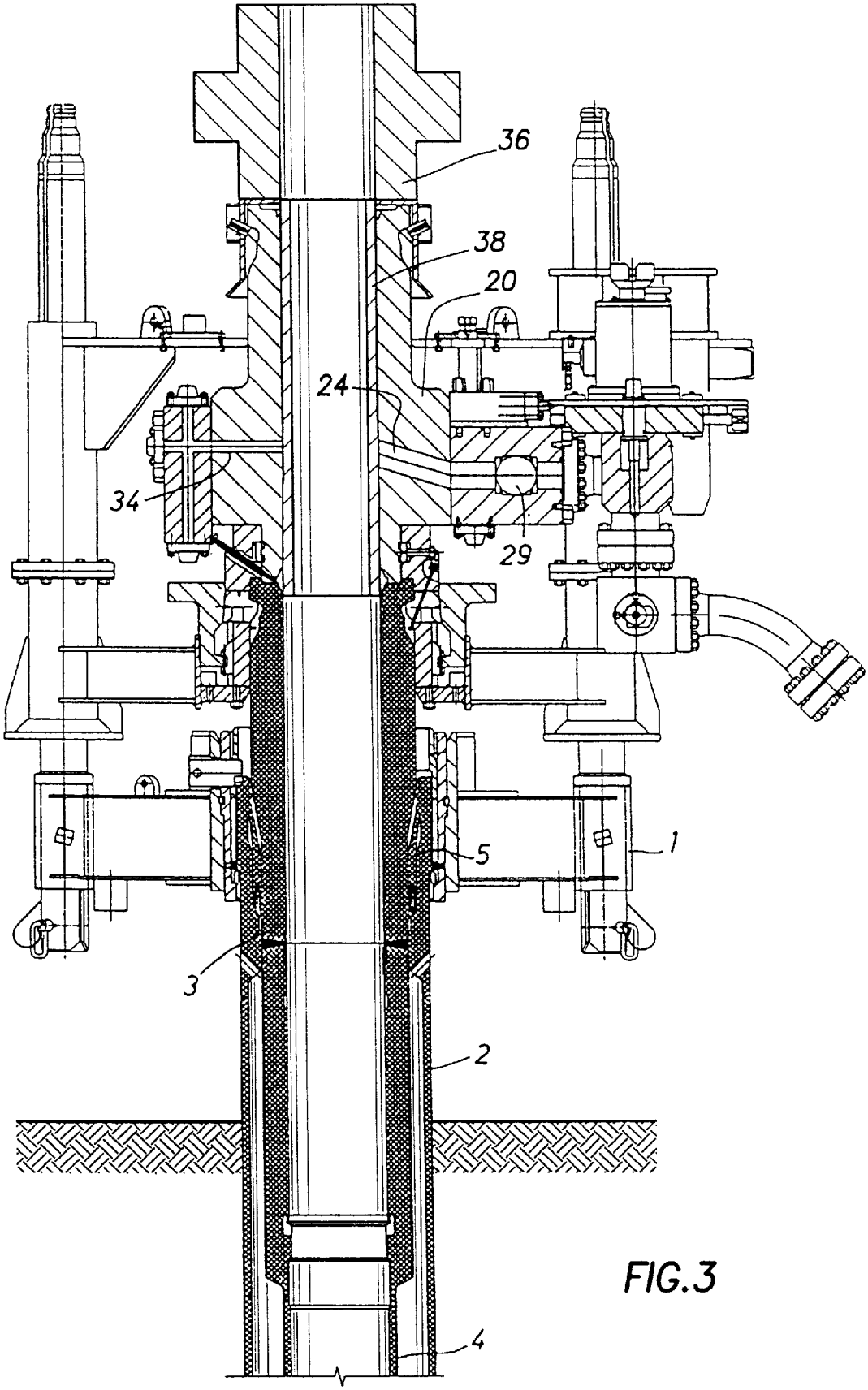
FIG. 3 is a detailed diagrammatic cross section of the wellhead assembly with a blowout preventer and sleeve prior to running the tubing hanger.

Referring to FIGS. 2 and 3, one method of the present invention for completing a wellhead assembly includes installing a wellhead housing 3; installing a blow out preventer 36 on the wellhead housing 3; running a tubing hanger 6 in through the blow out preventer 36 and wellhead housing 3, and landing it within the wellhead housing 3; running the in-line tree 10 through the blow out preventer 36 and into the wellhead housing 3 above the tubing hanger 6; with the or each valve 13A, 13B in the in-line tree 10 closed, removing the blow out preventer 36; running the horizontal tree 20 in over the in-line tree 10 and locating it on the top of the housing 3 in such a position that the lateral bore 16 in the horizontal tree 20 is aligned with the lateral bore 24 in the in-line tree 10; plugging the vertical through bore 11 in the in-line tree 10 above the lateral bore 24; and opening the or each valve 13A, 13B in the in-line tree 10 to allow the production fluid to flow through the wellhead assembly.

Still referring to FIGS. 2 and 3, another method of the present invention for completing a wellhead assembly includes installing a wellhead housing 3 on a wellhead which is not yet exposed to full production fluid pressure; locating a horizontal tree 10 directly on the wellhead housing 3; installing a blow out preventer 36 on the horizontal tree 20; further drilling and casing a well through the horizontal tree 20 and blow out preventer 36; running a tubing hanger 6 in through the blow out preventer 36 and horizontal tree 20 and landing it within the wellhead housing 3 or horizontal tree 20; running an in-line tree 10 in through the blow out preventer 36 and horizontal tree 20, and locating it above the tubing hanger 6 with a lateral bore 16 in the in-line tree 10 aligned with a lateral bore 24 in the horizontal tree 20; with a valve 13A of the in-line tree 10 closed, removing the blow out preventer 36; plugging a vertical through bore 11 in the in-line tree 10 above the lateral bore 24; and opening the in-line valve 13A to allow the production fluid to flow through tile wellhead assembly.

A removable sleeve 38 may be landed in the horizontal tree 20 to protect the lateral bores 24, 34 of the horizontal tree 20 during the drilling and easing process.

We claim:

1. A wellhead assembly comprising a wellhead housing; an in-line tree within the wellhead housing, the in-line tree comprising a housing having a vertical production through bore, an in-line valve in the vertical production through bore, and a lateral bore leading from the vertical production through bore out of the housing of the in-line tree; and landed on the wellhead housing a horizontal tree having a vertical through bore within which the in-line tree is situated and having a lateral bore which is aligned with the lateral bore in the in-line tree; wherein the in-line tree can be run in and retrieved through the vertical through bore of the horizontal tree without removing the horizontal tree.

2. A wellhead assembly according to claim 1, wherein two in-line valves are provided in the vertical production through throughbore of the in-line tree below the lateral bore.

3. A wellhead assembly according to claim 1 further comprising a tubing hanger which is landed within the wellhead assembly below the in-line tree, and which can be removed from the wellhead through the horizontal tree.

4. A wellhead assembly according to claim 3, wherein the tubing hanger is releasably attached to the in-line tree.

5. A wellhead assembly according to claim 1, wherein the in-line tree comprises a one piece housing containing the or each in-line valve, the vertical production through bore and lateral bore.

6. A wellhead assembly according to claim 1, wherein the or each in-line valve is a ball valve.

7. A wellhead assembly according to claim 1, wherein the or each valve is hydraulically or electrically actuated.

8. A wellhead assembly according to claim 1, wherein the in-line tree has a second vertical through bore with a lateral bore aligned with a corresponding lateral bore in the horizontal tree.

9. A method of completing a wellhead assembly, the method comprising installing a wellhead housing; installing a blow out preventer on the wellhead housing; running a tubing hanger in through the blow out preventer and wellhead housing, and landing it within the wellhead housing; running an in-line tree through the blow out preventer and into the wellhead housing above the tubing hanger; with a valve in the in-line tree closed, removing the blow out preventer; running a horizontal tree in over the in-line tree and locating it on the top of the housing in such a position that a lateral bore in the horizontal tree is aligned with a lateral bore in the in-line tree; plugging a vertical through bore in the in-line tree above the lateral bore; and opening the valve in the in-line tree to allow the production fluid to flow through the wellhead assembly.

10. A method of completing a wellhead assembly, the method comprising the steps of installing a wellhead housing on a wellhead which is not yet exposed to full production fluid pressure; locating a horizontal tree directly on the wellhead housing; installing a blow out preventer on the horizontal tree; further drilling and casing a well through the horizontal tree and blow out preventer; running a tubing hanger in through the blow out preventer and horizontal tree and landing it within the wellhead housing or horizontal tree; running an in-line tree in through the blow out preventer and horizontal tree, and locating it above the tubing hanger with a lateral bore in the in-line tree aligned with a lateral bore in the horizontal tree; with the a valve of the in-line tree closed, removing the blow out preventer; plugging a vertical through bore in the in-line tree above the lateral bore; and opening the in-line valve to allow the production fluid to flow through the wellhead assembly.

11. A method according to claim 8, further comprising the step of landing a removable sleeve in the horizontal tree to protect the lateral bores of the horizontal tree during the drilling and casing process.

12. An apparatus received within a common bore formed by a wellhead and a horizontal tree mounted on the wellhead, the horizontal tree having a lateral production bore, comprising:

a generally tubular housing adapted to be received within the common bore;

said housing having a vertical through bore and a lateral bore in communication with said vertical through bore;

said housing having a closure member disposed within said vertical through bore to open and close said vertical through bore;

said housing adapted to be supported within the wellhead and to extend into the horizontal tree; and said lateral bore adapted to be in fluid communication with said lateral production bore.

13. The apparatus of claim 12 wherein said closure member is a valve.

14. The apparatus of claim 12 wherein said housing further includes an annulus bore.

15. The apparatus of claim 12 further including a tubing hanger mounted on said housing.

16. The apparatus of claim 12 further including a plug member for closing said vertical through bore above said lateral bore.

17. A method for completing a well comprising:

installing a wellhead, a tubing hanger, an inner tree member, and horizontal tree;

supporting the tubing hanger and inner tree member within the wellhead with a portion of the inner tree member extending into the horizontal tree;

providing a through bore in the inner tree member with a valve disposed in the through bore to open and close the through bore;

communicating the through bore with a lateral production bore in the horizontal tree through a bore in the inner tree member;

closing the through bore above the lateral production bore;

opening the valve; and producing through the through bore, inner tree member bore, and lateral production bore.

18. The method of claim 17 further comprising retrieving the inner tree member through the horizontal tree.

19. The method of claim 17 further comprising removing the horizontal tree.

20. A method for completing a well comprising:

installing a wellhead and blowout preventer;

installing and supporting a tubing hanger and inner tree member within the wellhead;

providing a through bore with valve in the inner tree member with the valve initially being closed;

removing the blowout preventer;

installing a horizontal tree on the wellhead with a portion of the inner tree member extending into the horizontal tree;

communicating the through bore with a lateral production bore in the horizontal tree through a bore in the inner tree member;

closing the through bore above the lateral production bore;

opening the valve; and producing through the through bore, inner tree member bore, and lateral production bore.

21. A method for drilling and completing a well comprising:

installing a wellhead, horizontal tree and blowout preventer forming a common bore;

drilling and casing the well through the common bore;

installing a tubing hanger and inner tree member within the common bore;

providing a through bore with valve in the inner tree member with the valve initially being closed;

removing the blowout preventer;

communicating the through bore with a lateral production bore in the horizontal tree through a bore in the inner tree member;

closing the through bore above the lateral production bore;

opening the valve; and producing through the through bore, inner tree member bore, and lateral production bore.

* * * * *